US012582243B2

(12) United States Patent
Chu et al.

(10) Patent No.: US 12,582,243 B2
(45) Date of Patent: Mar. 24, 2026

(54) CUP HOLDING ASSEMBLY AND DENTAL CUP DISPENSER USING SAME

(71) Applicant: OSSTEMIMPLANT CO., LTD., Seoul (KR)

(72) Inventors: Seon Kyeong Chu, Incheon (KR); Jun Young Kim, Suwon-si (KR); Kyun Ha Han, Incheon (KR)

(73) Assignee: OSSTEMIMPLANT CO., LTD., Seoul (KR)

( * ) Notice: Subject to any disclaimer, the term of this patent is extended or adjusted under 35 U.S.C. 154(b) by 253 days.

(21) Appl. No.: 18/269,847

(22) PCT Filed: Dec. 21, 2021

(86) PCT No.: PCT/KR2021/019517
§ 371 (c)(1),
(2) Date: Jun. 27, 2023

(87) PCT Pub. No.: WO2022/145854
PCT Pub. Date: Jul. 7, 2022

(65) Prior Publication Data

US 2024/0057790 A1 Feb. 22, 2024

(30) Foreign Application Priority Data

Dec. 28, 2020 (KR) ..... 10-2020-0184891

(51) Int. Cl.
*A47F 1/10* (2006.01)

(52) U.S. Cl.
CPC ..... *A47F 1/106* (2013.01)

(58) Field of Classification Search
CPC ..... B67D 1/06; B65G 59/102; B65G 59/105
(Continued)

(56) References Cited

U.S. PATENT DOCUMENTS 1,593,717 A * 7/1926 Frick ..... B65G 59/105 221/223
1,660,247 A * 2/1928 Wooten ..... B65G 59/105 221/221

(Continued)

FOREIGN PATENT DOCUMENTS

JP 61-188031 A 8/1986
JP 8-90361 A 4/1996

(Continued)

OTHER PUBLICATIONS

Extended European Search Report dated May 16, 2024 from the European Patent Office in Application No. 21915652.8.

(Continued)

*Primary Examiner* — Rakesh Kumar
(74) *Attorney, Agent, or Firm* — Sughrue Mion, PLLC

(57) ABSTRACT

Provided is a cup holding assembly and a dental cup dispenser using same, the cup holding assembly including a plurality of holding modules, each has a seat portion and can hold a cup by contacting the cup from a plurality of directions in a mounting space and a rotary plate which has an inner opening overlapping with the mounting space and includes at least one spiral rail coupled to each of the plurality of seat portions in a non-fixed manner, thereby providing a spiral guide path to each of the plurality of seat portions. Each of the plurality of seat portions moves along the spiral guide path according to the rotation of the rotary plate. The plurality of holding modules move in a direction toward or away from the mounting space or the center of the first inner opening according to the movements of the plurality of seat portions.

18 Claims, 25 Drawing Sheets

(58) Field of Classification Search
USPC ..... 221/96, 221, 223, 241; 312/44, 43
See application file for complete search history.

(56) References Cited

U.S. PATENT DOCUMENTS 1,680,238 A * 8/1928 Baker ..... B65G 59/105 221/104
1,975,649 A * 10/1934 Reifsnyder ..... A47F 1/085 221/308
2,139,433 A * 12/1938 Bares ..... G07F 13/10 221/223
2,315,827 A * 4/1943 Tansley ..... A47F 1/085 221/297
2,520,538 A * 8/1950 Gilbertsen ..... A47F 1/085 221/199
2,946,481 A * 7/1960 Carew ..... G07F 13/10 221/222
3,071,292 A * 1/1963 Atwood ..... B65G 59/102 221/241
3,163,323 A * 12/1964 Behrens ..... A47F 1/085 221/304
3,203,587 A * 8/1965 Mount ..... A47F 1/085 221/304
3,581,934 A 6/1971 Sciascia
3,790,023 A * 2/1974 Filipowicz ..... A47F 1/085 221/304
4,033,478 A * 7/1977 House ..... G07F 11/16 221/279
4,199,076 A * 4/1980 Brown ..... B65D 83/766 D6/516
4,234,101 A * 11/1980 Pastore ..... A47F 1/065 221/241
4,658,983 A 4/1987 Suttles
4,854,479 A * 8/1989 Callahan ..... A47F 1/123 221/241
4,881,660 A * 11/1989 Suttles ..... A47F 1/12 221/44
4,927,053 A * 5/1990 Mayfield, III ..... B65G 1/07 312/45
4,953,746 A * 9/1990 Andriash ..... B65D 83/0817 312/61
5,135,136 A 8/1992 Moone
5,839,605 A * 11/1998 Hadtke ..... A47F 1/065 312/43
5,960,989 A * 10/1999 Gunderson ..... B65G 59/106 221/229
6,592,001 B2 * 7/2003 Lewis ..... A47K 10/3818 221/33
7,207,462 B2 * 4/2007 Gunderson ..... G07F 11/24 221/24
7,325,701 B1 * 2/2008 Meyer ..... A47F 1/085 221/221
7,789,265 B2 * 9/2010 Kearney ..... B60N 3/106 220/737
2001/0032860 A1 * 10/2001 Roethel ..... A47F 1/065 221/307
2004/0065672 A1 * 4/2004 Kaplan ..... A47F 1/106 221/303
2005/0077314 A1 * 4/2005 Boykin ..... A47F 1/123 221/307
2006/0060490 A1 * 3/2006 Rodriguez ..... B65D 83/0805 206/233
2009/0152285 A1 6/2009 Kerney et al.
2011/0284572 A1 * 11/2011 Meyer ..... A47F 1/065 221/251
2014/0076917 A1 * 3/2014 Siebel ..... A47K 10/427 221/35
2015/0250290 A1 * 9/2015 Holloway ..... A45D 40/06 401/31
2016/0324333 A1 * 11/2016 Walton ..... A47F 1/065
2024/0057790 A1 * 2/2024 Chu ..... A61C 19/00

FOREIGN PATENT DOCUMENTS

KR 10-2004-0043076 A 5/2004
KR 10-2010-0022413 A 3/2010
KR 10-2015-0086131 A 7/2015
KR 10-2136419 B1 7/2020

OTHER PUBLICATIONS

Communication issued Aug. 6, 2024 in Japanese Application No. 2023-539771.
International Search Report for PCT/KR2021/019517 dated Apr. 11, 2022 (PCT/ISA/210).
Office Action ("Notice of Refusal") mailed Feb. 12, 2020 in Japanese Application No. 2023-539771.

* cited by examiner 35a, 35b, 35c, 35d 35a, 35b, 35c, 35d 35a, 35b, 35c, 35d 35a, 35b, 35c, 35d

CUP HOLDING ASSEMBLY AND DENTAL CUP DISPENSER USING SAME

CROSS REFERENCE TO RELATED APPLICATIONS

This application is a National Stage of International Application No. PCT/KR2021/019517 filed Dec. 21, 2021, claiming priority based on Korean Patent Application No. 10-2020-0184891 filed Dec. 28, 2020, the entire disclosures of which are incorporated herein by reference.

TECHNICAL FIELD

The present invention relates to a cup holding assembly and a dental cup dispenser using the same, and more particularly, to a cup holding assembly capable of holding a cup and allowing a user to take out the cup, and a dental cup dispenser using the same.

BACKGROUND ART

Generally, dental examination and treatment are performed in the oral cavity of a patient while the examinee is lying on a unit chair.

In the dental unit chair, a lighting device for emitting light to the oral cavity, a doctor table including various treatment tools, a unit chair monitor arm on which a monitor for displaying the inside of the oral cavity, displaying computerized tomography (CT) image information, watching a television (TV), and the like is installed, a water supply apparatus, and a table for convenience of the patient may be installed.

Various apparatuses or instruments installed on the unit chair are installed to provide an efficient movement path and allow convenience operation in order to provide movement and convenience of the patient or a practitioner and sufficient functions during a procedure.

Particularly, the dental unit chair generally includes a cup dispenser from which the patient can take out a cup to rinse the patient's mouth.

However, cup dispensers provided in the conventional dental unit chairs have problems that only a cup having a predetermined size may be used, and when a size (a circumference or diameter of the cup) of the cup is changed, the cup cannot be used.

Particularly, since the sizes of cups commonly used in the dentists are different from country to country, there is an inconvenience that cup dispensers which can accommodate different cups should be installed in each country.

Technical Problem

The present invention is directed to providing a cup holding assembly capable of holding various types of cups having various sizes and a dental cup dispenser using the same.

The present invention is also directed to providing a cup holding assembly from which cups having various sizes are easily taken out and a dental cup dispenser using the same.

The present invention is also directed to providing a cup holding assembly capable of being used in various countries using cups having different sizes and a dental cup dispenser using the same.

Technical Solution

One aspect of the present invention provides a cup holding assembly including a plurality of holding modules each having a seating part and disposed to hold a cup by coming into contact with the cup in a plurality of directions in a holding space, and a rotary plate in which an inner opening overlaps the holding space and which has at least one spiral rail coupled to the plurality of seating parts in a non-fixed manner to provide a spiral guide path to each of the plurality of seating parts, wherein the plurality of seating parts each move along the spiral guide path according to rotation of the rotary plate, and the plurality of holding modules move toward or away from a center of the holding space or a center of a first inner opening according to movement of the plurality of seating parts.

Each of the plurality of seating parts may have a shape protruding outward from the holding module, and the spiral rail may be formed to be recessed to accommodate the protruding shape of the seating parts.

Each of the plurality of seating parts may have a cylindrical shape or arc shape and protrude outward from the holding module.

Each of the plurality of seating parts may have a recessed shape in the holding module, and the spiral rail may be formed in a protruding shape to be engaged with the recessed shape of the seating parts.

The plurality of seating parts may be formed at different positions on the plurality of holding modules so that the plurality of holding modules come into contact with the cup at the same distance from the center of the holding space or the center of the first inner opening.

At least two holding modules among the plurality of holding modules may each include a lever whose one end is pivotably fixed to one side of the holding module and the other end is coupled to the other side of the holding module using elastic members.

An extent of clockwise or counterclockwise rotation of the lever may be changed by the elastic member according to whether the cup is present or whether the cup is taken out.

Another aspect of the present invention provides a dental cup dispenser including a first case which includes a plurality of first accommodation portions and in which a holding space is formed, a plurality of holding modules which are accommodated in the plurality of first accommodation portions, are movable within the first accommodation portions, each have a seating part, and hold a cup by coming into contact with the cup in the holding space in a plurality of directions, and a rotary plate in which a first inner opening overlaps the holding space and which includes at least one spiral rail coupled to the plurality of seating parts in a non-fixed manner to provide a spiral guide path to each of the plurality of seating parts, wherein the plurality of seating parts each move along the spiral guide path according to rotation of the rotary plate, and the plurality of holding modules move toward or away from a center of the holding space or a center of the first inner opening according to movement of the plurality of seating parts. A curvature of the spiral rail decreases away from the holding space and the first inner opening.

The plurality of seating parts may be formed at different positions on the plurality of holding modules so that the plurality of holding modules are positioned at the same distance from the center of the holding space or the center of the first inner opening.

At least two holding modules among the plurality of holding modules may each include a lever whose one end is pivotably fixed to one side of the holding module and the other end is coupled to the other side of the holding module by an elastic member.

An extent of clockwise or counterclockwise rotation of the lever may be changed by the elastic member according to whether a cup is present or whether the cup is taken out.

A first protrusion may be formed on a lower end of one side of the lever, and the elastic member may be pushed toward an inside of the holding module when the cup is taken out.

A second protrusion may be formed on an upper end of the other side of the lever.

The dental cup dispenser may further include a second case coupled to the first case so that the plurality of holding modules and the rotary plate are positioned between the first case and the second case.

A second inner opening overlapping the holding space may be formed in the second case.

The second case may include at least one position fixing member, and the rotary plate may include a second accommodation portion for accommodating the at least one position fixing member at an edge of the spiral rail.

The second accommodation portion may be formed as a plurality of grooves forming an arc, and the at least one position fixing portion may move along the plurality of grooves as the rotary plate relatively rotates with respect to the first case or the second case.

When the at least one position fixing member is seated in any groove among the plurality of grooves, movement of the rotary plate may be temporarily restricted until an external force is applied.

The at least one position fixing member may include an elastic member on which a third protrusion having a size sufficient for each of the grooves is formed.

Advantageous Effects

A cup holding assembly and a dental cup dispenser using the same according to the present invention have effects as follows.

According to the present invention, there is an effect of stably holding cups having various sizes using one cup holding assembly or cup dispenser.

In addition, according to the present invention, there is an effect that a user can easily take out cups having various sizes.

In addition, according to the present invention, there is an effect that one cup holding assembly or cup dispenser can be applied in various countries in which cups having different sizes are used.

However, the scope of the present invention is not limited by the above-described effects.

MODES OF THE INVENTION

Figure 1:
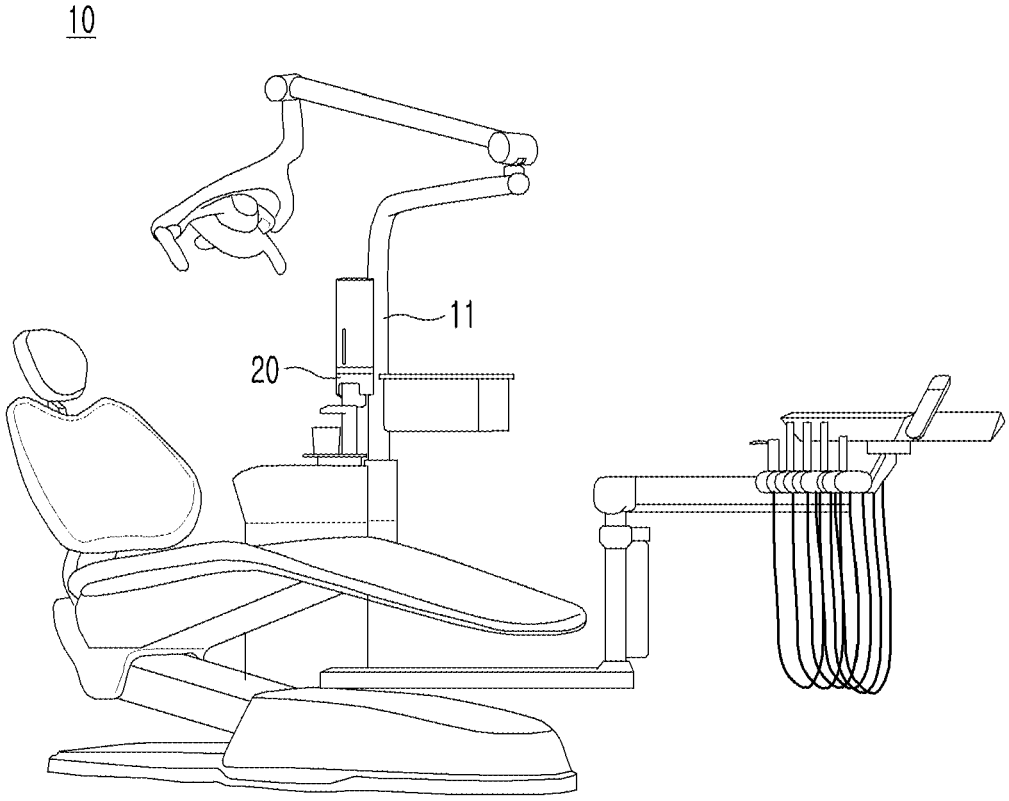
FIG. 1 is a view illustrating one example of an exterior of a dental unit chair according to the present invention.

Content related to operational effects in addition to a technical configuration for the objectives of a cup holding assembly and a dental cup dispenser using the same according to the present invention will be clearly understood through the following detailed description with reference to the accompanying drawings in which exemplary embodiments of the present invention are illustrated.

The following content only illustrates principles of the present invention. Therefore, although not explicitly described or illustrated in this specification, those skilled in the art can invent various devices which implement the principles of the present invention and are included in the concept and scope of the present invention. In addition, it should be understood that all conditional terms and embodiments listed herein are, in principle, clearly intended only for the purpose of making the concept of the present invention understood, and not limited to such specifically listed embodiments and states.

In addition, it should be understood that all detailed descriptions for not only the principles, aspects, and embodiments but also specific embodiments of the present invention are intended to encompass structural and functional equivalents of the descriptions. In addition, it should be understood that such equivalents include not only currently known equivalents but also equivalents to be developed in the future, that is, all devices invented to perform the same functions regardless of the structure.

In addition, in the description of the present disclosure, specific descriptions for the related art are omitted when deemed to unnecessarily obscure the gist of the present invention. Furthermore, components in the accompanying drawings are not necessarily drawn according to scales. For example, sizes of some components in the drawings may be exaggerated compared to other components in order to help understand the embodiments of the present invention. In addition, like numbers in different drawings may refer to like elements, and similar numbers may refer to similar elements but do not necessarily refer thereto.

In the present invention defined by the claims in this specification, since functions provided by variously listed means are combined and comply with a manner required by the claims, it should be understood that any means capable of providing such functions are equivalent to those found from this specification.

The above-described objectives, features, and advantages will be clearer through the following detailed descriptions related to the accompanying drawings, and accordingly, those skilled in the art in the present invention may easily implement the technical spirit of the present invention.

Hereinafter, various embodiments according to the technical spirit of the present invention will be described in detail with reference to the accompanying drawings.

FIG. 1 is a view illustrating one example of an exterior of a dental unit chair 10 according to the present invention.

The dental unit chair 10 to which the present invention is applied may be representatively used in a dentist but is not limited thereto.

As illustrated in FIG. 1, the dental unit chair 10 may basically include a seat on which an examinee's legs are placed, a backrest on which the examinee's back leans, and a headrest which supports the examinee's head.

Armrests on which the examinee's arms are placed may be formed on side surfaces of at least one of the backrest and the seat.

In addition, the dental unit chair 10 may include a base which supports the seat, a driving unit which drives at least one of the backrest and the seat, and a control unit which controls the driving unit.

In addition, the dental unit chair 10 may include at least one of a lighting unit for emitting light to an examinee, a water supply unit for supplying gargle water for rinsing the examinee's mouth, the control unit, a display unit, a foot control unit, and a power supply unit.

In addition, the dental unit chair 10 may include a work table.

A representative example of the work table is a doctor table for holding various instruments for examination and treatment in the dentist.

For example, the work table may include an interface configured to hold instruments, a medical chart, and the like for examining the examinee visiting the dentist or manipulate the instruments.

At least one of electricity, pneumatic pressure, and hydraulic pressure to be used for operation of a procedure instrument may be supplied to the work table. For example, an oral light, which is one procedure instrument, may be turned on using supplied electricity.

In addition, the work table may include various switches. When a position of a practitioner is considered, the work table may be positioned at a distance at which the practitioner may easily reach by stretching his or her hand.

Accordingly, the various switches capable of controlling each part of the dental unit chair 10 may be positioned on the work table.

Meanwhile, since the examinee should use a cup to rinse his or her mouth using the water supply unit, the dental unit chair 10 may include a cup dispenser 20 so that the examinee may take out the cup.

For example, as illustrated in FIG. 1, the cup dispenser 20 may be mounted on a pole 11 of the dental unit chair 10.

Figure 2:
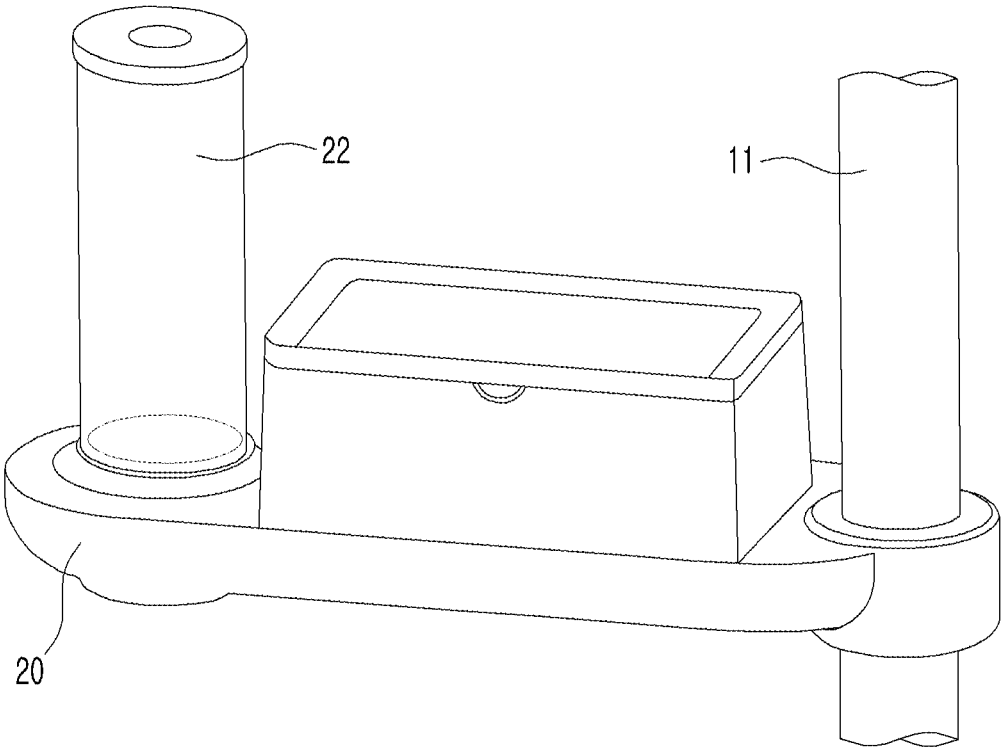
FIGS. 2 and 3 are views illustrating an exterior of a cup dispenser according to one embodiment of the present invention in directions opposite to each other.
Figure 3:
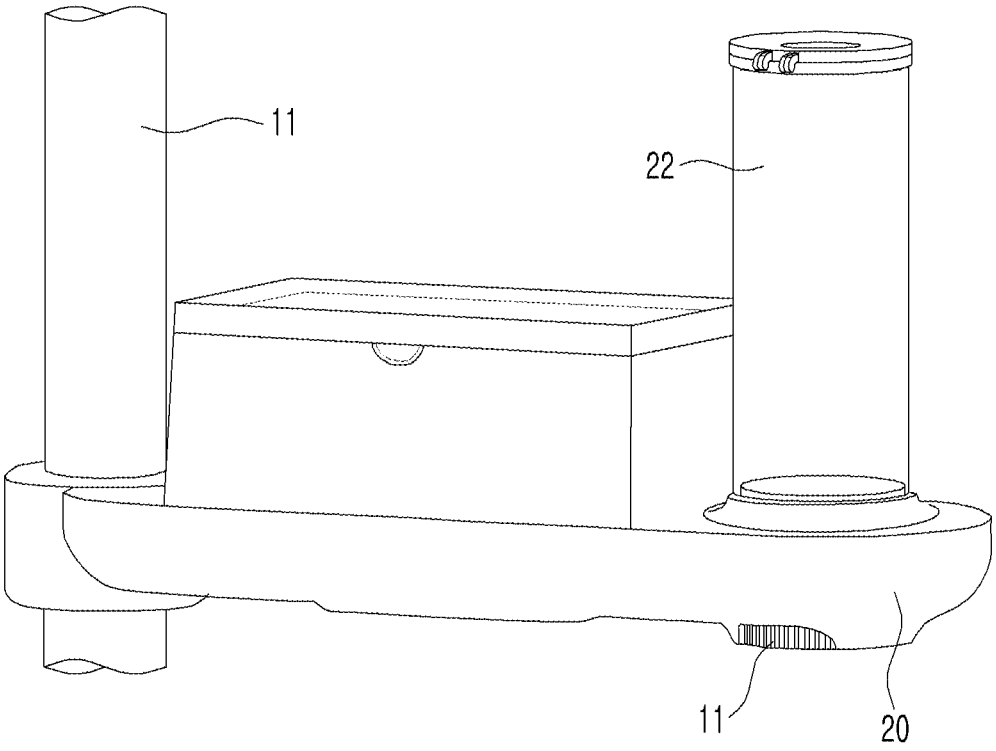
Figure 4:
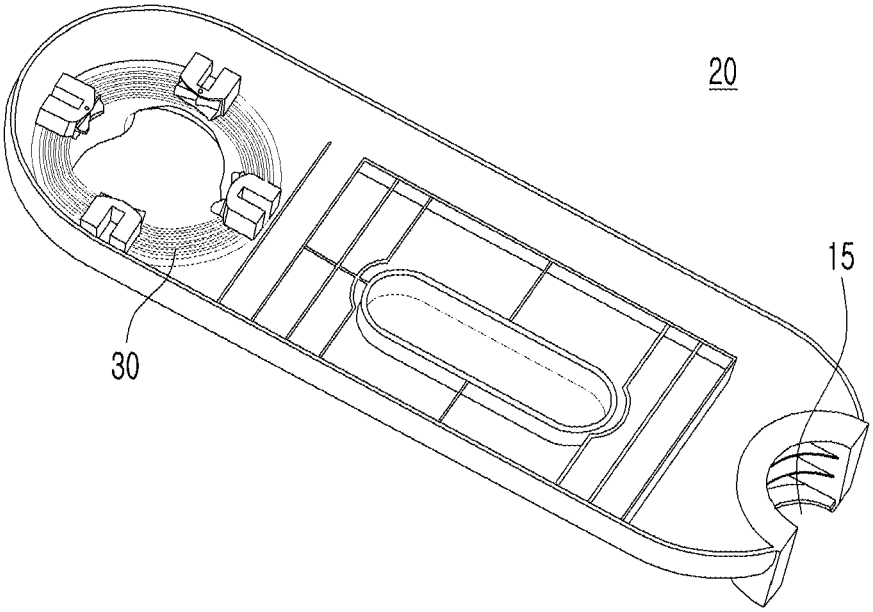
FIG. 4 is a view illustrating an interior of the cup dispenser according to one embodiment of the present invention.

FIGS. 2 and 3 are views illustrating an exterior of the cup dispenser 20 according to one embodiment of the present invention in directions opposite to each other, and FIG. 4 is a view illustrating an interior of the cup dispenser 20 according to one embodiment of the present invention.

Referring to FIGS. 2 to 4, the dental cup dispenser 20 according to one embodiment of the present invention includes a cup holding assembly 30, which will be described below, according to one embodiment of the present invention and an opening 15 fitted onto the pole 11 of the dental unit chair 10.

Referring to FIG. 4, the cup holding assembly 30 according to one embodiment of the present invention may be mounted on the cup dispenser 20.

That is, the cup dispenser 20 may be mounted to correspond to the pole 11 in a manner in which the pole 11 passes through and is firmly fitted into the opening 15. However, the manner in which the cup dispenser 20 is mounted on the dental unit chair 10 is not limited thereto and may vary.

A part of reference number 22 in FIGS. 2 and 3 may be used as a cover or stopper for covering or protecting an upper portion of the cup holding assembly 30 and may be a cup storage box 22 mounted on the cup holding assembly 30. A plurality of cups may be stored in a stacked state in the cup storage box 22.

Hereinafter, the cup holding assembly 30 according to one embodiment of the present invention will be described in detail with reference to the necessary drawings.

FIGS. 5 to 14 are views for describing the cup holding assembly 30 according to one embodiment of the present invention.

Figure 5:
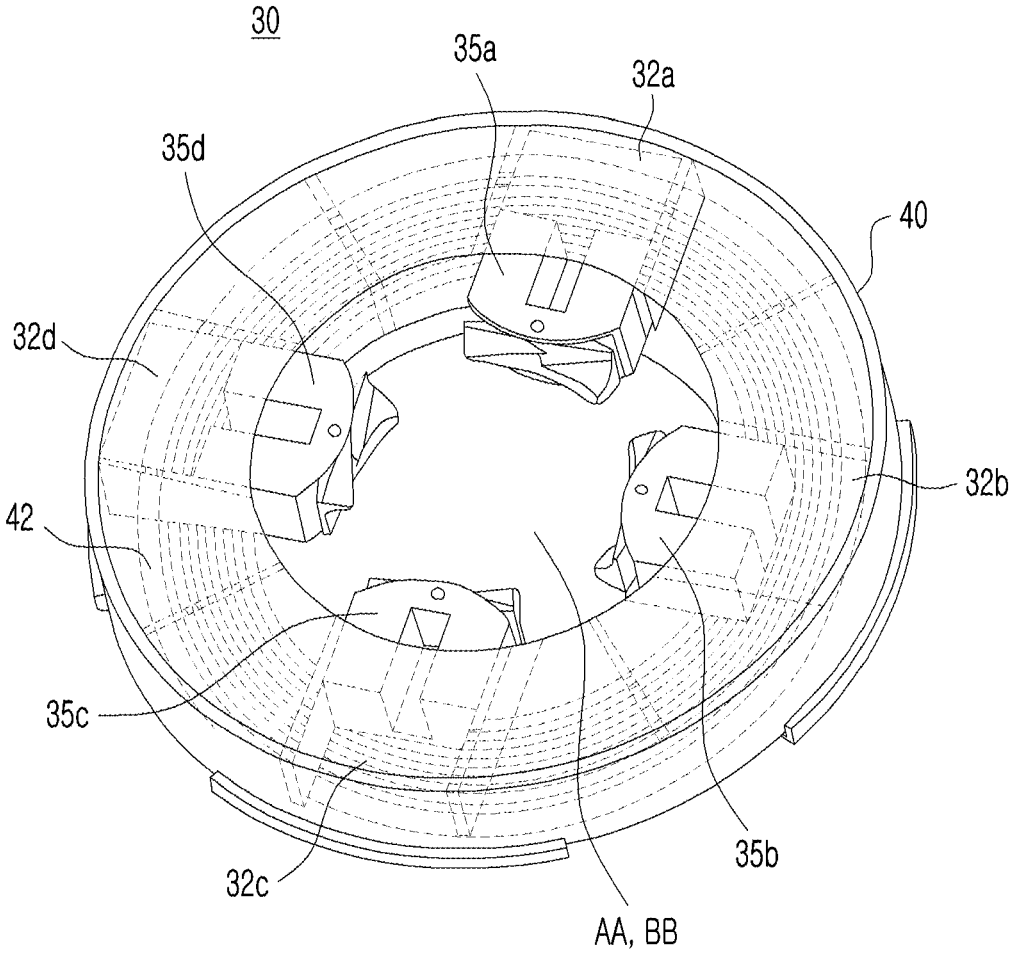
FIG. 5 is a view illustrating an exterior of a cup holding assembly according to one embodiment of the present invention.
Figure 6:
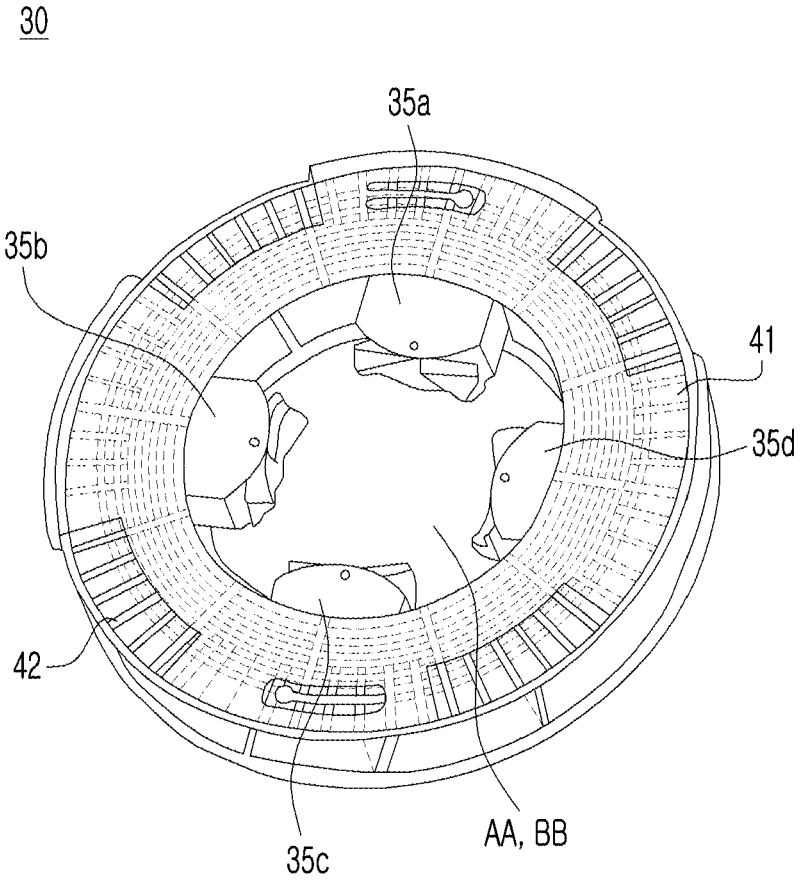
FIG. 6 is a view illustrating the exterior of the cup holding assembly according to one embodiment of the present invention in a direction opposite to a viewing direction of FIG. 5.
Figure 7:
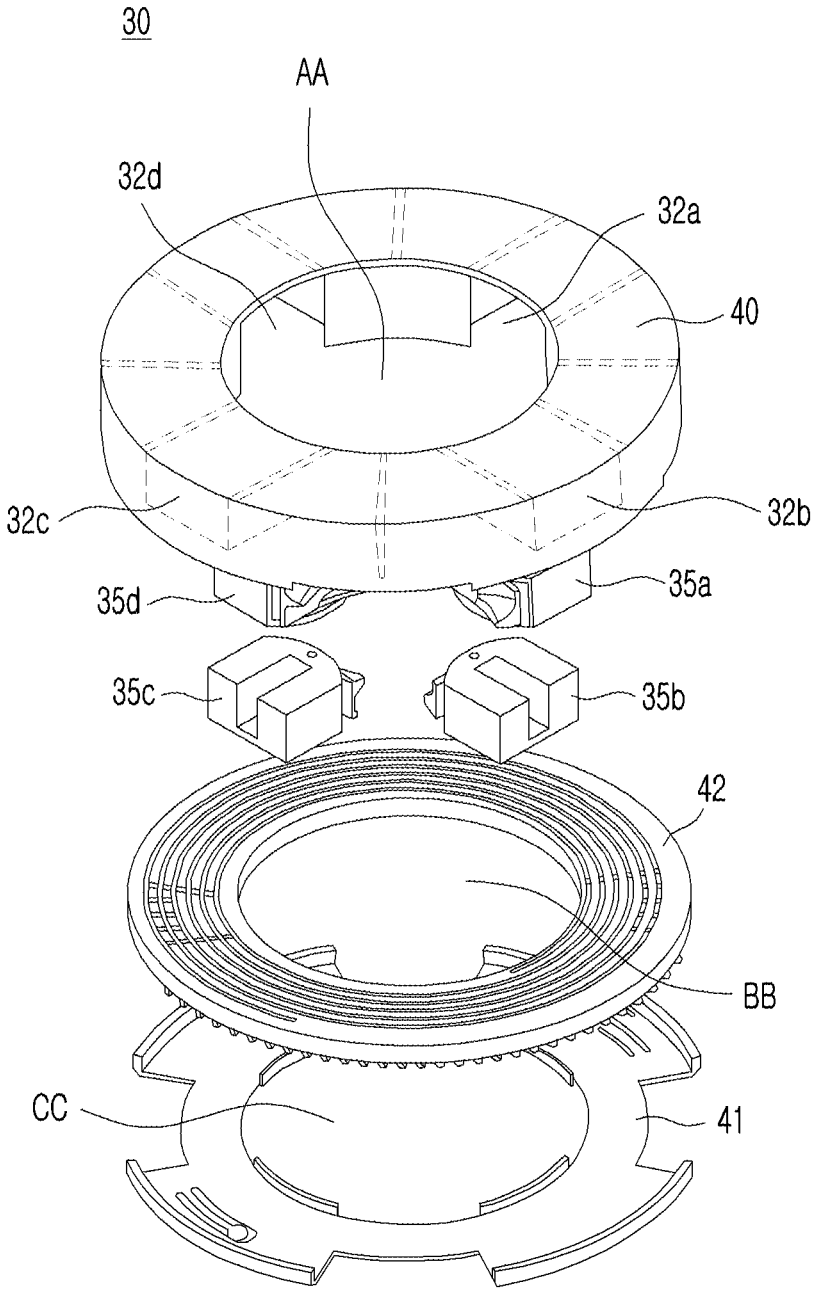
FIG. 7 is an exploded view illustrating the cup holding assembly according to one embodiment of the present invention.

FIG. 5 is a view illustrating an exterior of the cup holding assembly 30 according to one embodiment of the present invention, FIG. 6 is a view illustrating the exterior of the cup holding assembly 30 according to one embodiment of the present invention in a direction opposite to a viewing direction of FIG. 5, and FIG. 7 is an exploded view illustrating the cup holding assembly 30 according to one embodiment of the present invention.

Referring to FIGS. 5 to 7, the cup holding assembly 30 according to one embodiment of the present invention basically includes a plurality of holding modules 35*a*, 35*b*, 35*c*, and 35*d* and a rotary plate 42.

In addition, referring to FIGS. 5 to 7, the cup holding assembly 30 according to one embodiment of the present invention may further include a first case 40 and a second case 41.

Referring to FIGS. 5 to 7, a holding space AA may be formed in the first case 40, and the first case 40 may include a plurality of first accommodation portions 32*a*, 32*b*, 32*c*, and 32*d*.

The second case 41 may be coupled to the first case 40 so that the plurality of holding modules 35*a*, 35*b*, 35*c*, and 35*d* and the rotary plate 42 are positioned between the first case 40 and the second case 41.

In this case, the second case 41 may be firmly coupled to the first case 40 to not relatively move with respect to the first case 40.

As illustrated in FIG. 7, a second inner opening CC may be formed in the second case 41.

The first case 40 may constitute an upper portion of the cup holding assembly 30, and the second case 41 may constitute a lower portion of the cup holding assembly 30, but the present invention is not limited thereto.

In this specification, an example in which the cup holding assembly 30 according to one embodiment of the present invention includes the plurality of four holding modules 35*a*, 35*b*, 35*c*, and 35*d* is mainly described, but the number of the plurality of holding modules is not necessarily limited thereto.

In this case, when the number of the plurality of holding modules is changed, the number of the plurality of accommodation portions may also be changed correspondingly.

For example, the cup holding assembly 30 according to one embodiment of the present invention may also include a plurality of holding modules and the plurality of accommodation portions of which the numbers are the same.

The plurality of holding modules 35*a*, 35*b*, 35*c*, and 35*d* serve to hold a cup by coming into direct contact with the cup.

Figure 10:
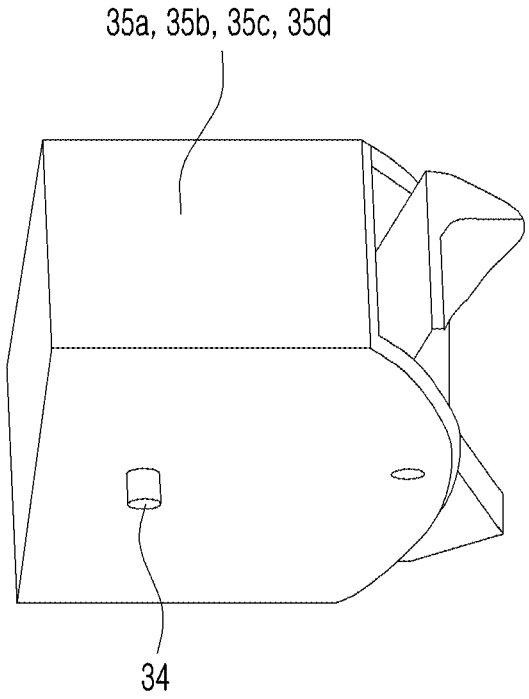
FIG. 10 is a view illustrating an example of a case in which a seating part provided in a holding module has a cylindrical shape according to one embodiment of the present invention.
Figure 11:
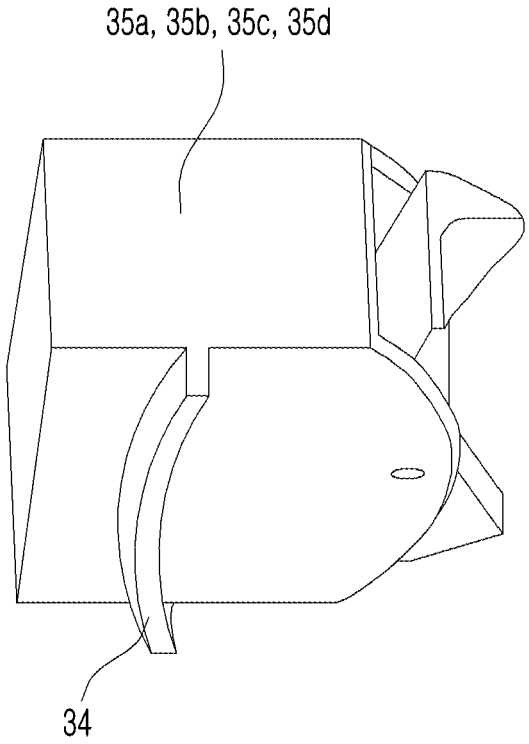
FIG. 11 is a view illustrating an example of a case in which the seating part provided in the holding module has an arc shape according to one embodiment of the present invention.
Figure 12:
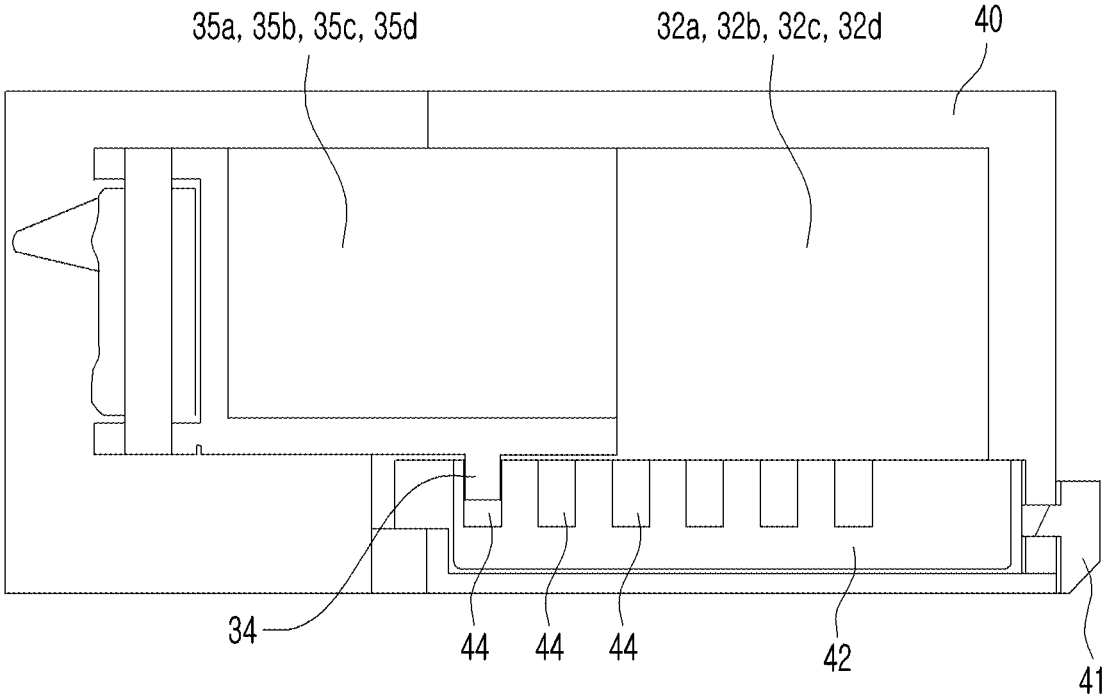
FIG. 12 is a vertical cross-sectional view for describing a structure in which the holding module is seated on the spiral rail according to one embodiment of the present invention.

The plurality of holding modules 35*a*, 35*b*, 35*c*, and 35*d* may include seating parts 34 (see FIGS. 10 to 12).

The seating parts 34 (see FIGS. 10 to 12) are components which are seated on or engaged with a spiral rail 44 so that the plurality of holding modules 35*a*, 35*b*, 35*c*, and 35*d* move along the spiral rail 44 formed on the rotary plate 42.

That is, the plurality of holding modules 35*a*, 35*b*, 35*c*, and 35*d* may include the seating parts 34 (see FIGS. 10 to 12) and be disposed to come into contact with the cup in a plurality of directions in the holding space AA to hold the cup.

A first inner opening BB overlapping the holding space AA is formed in the rotary plate 42, and the rotary plate 42 includes at least one spiral rail 44 which is non-fixedly coupled to the plurality of seating parts 34 (see FIGS. 10 to 12).

The rotary plate 42 may include the at least one spiral rail 44 to provide a spiral guide path to the plurality of seating parts 34.

In the present specification, a case in which the rotary plate 42 includes one spiral rail 44 will be described. However, the rotary plate 42 may also have a plurality of spiral rails 44.

Figure 8:
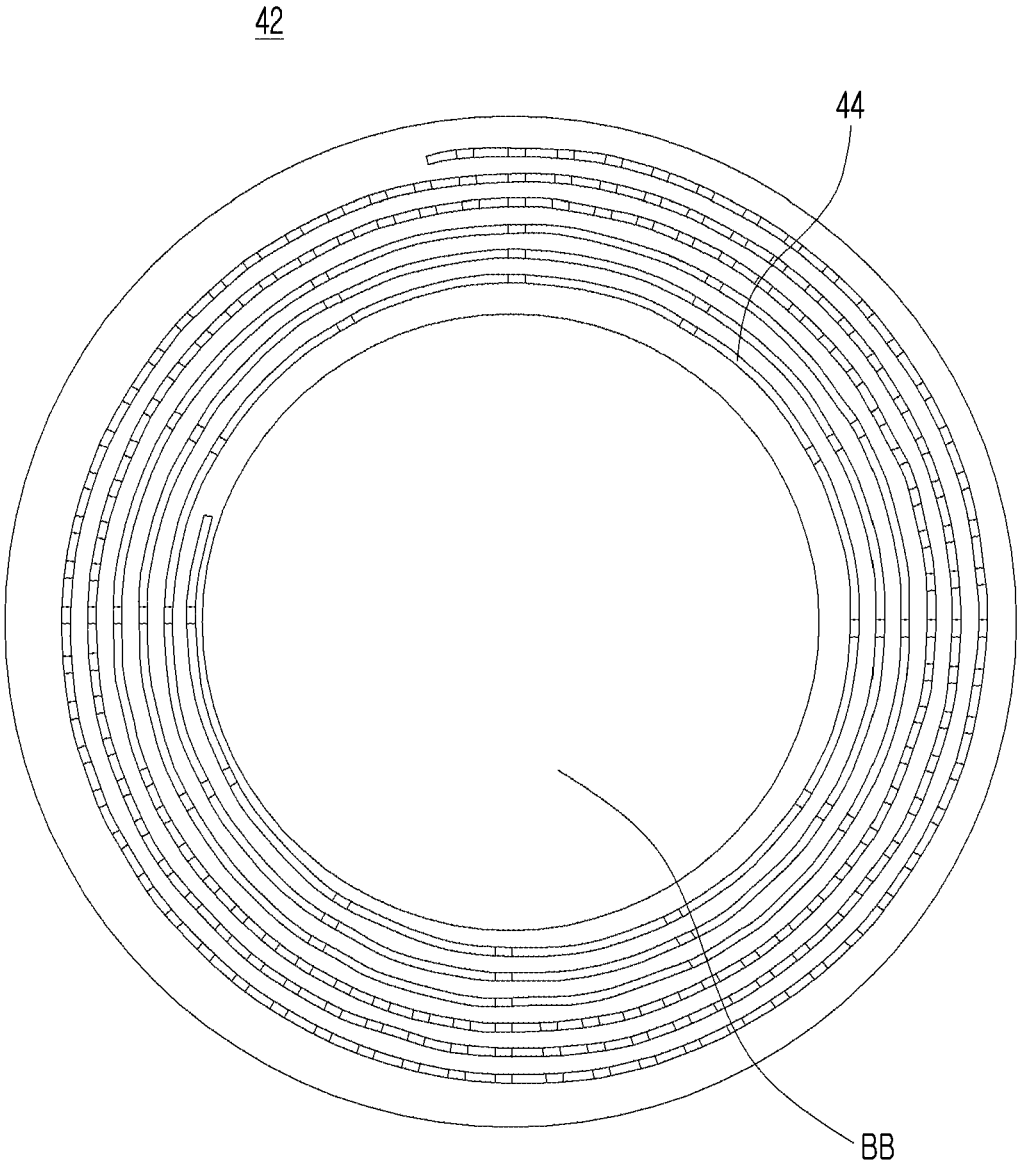
FIG. 8 is a view illustrating an example of a rotary plate provided in the cup holding assembly according to one embodiment of the present invention.
Figure 9:
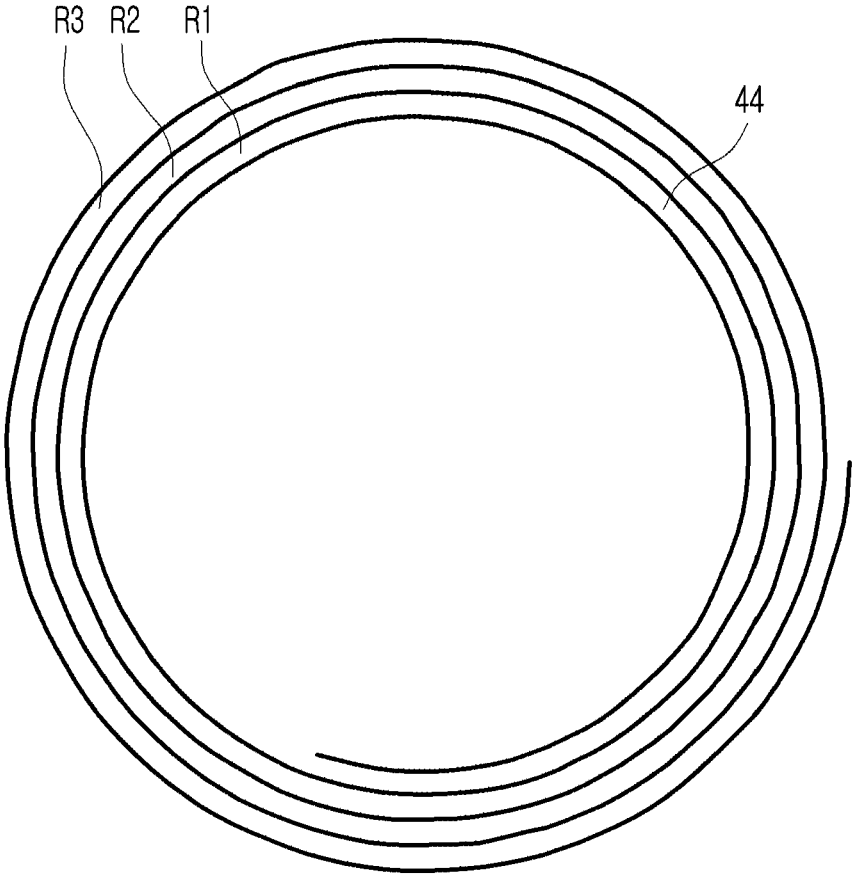
FIG. 9 is a conceptual view illustrating a spiral rail formed on the rotary plate according to one embodiment of the present invention.

FIG. 8 is a view illustrating an example of the rotary plate 42 provided in the cup holding assembly 30 according to one embodiment of the present invention. FIG. 9 is a conceptual view illustrating the spiral rail 44 formed on the rotary plate according to one embodiment of the present invention.

A curvature of the spiral rail 44 may decrease away from the holding space AA and the first inner opening BB.

For example, referring to FIG. 9, among regions R1, R2, and R3 of the spiral rails 44, a curvature of the region R1 is the largest, and a curvature of the region R3 is the smallest.

Meanwhile, a structure in which the plurality of holding modules 35*a*, 35*b*, 35*c*, and 35*d* are seated on the spiral rail 44 by the seating parts 34 may vary.

Each of the seating parts 34 formed on one of the plurality of holding modules 35*a*, 35*b*, 35*c*, and 35*d* may have a shape protruding outward from the holding module. In this case, the spiral rail 44 may be formed to be recessed to accommodate the protruding shape of the seating part 34 (see FIG. 12).

The seating part 34 may have any protruding shape.

For example, the seating part 34 may be formed in a cylindrical shape or arc shape to protrude outward from the holding module.

FIG. 10 is a view illustrating an example of a case in which the seating part 34 provided in a holding module has the cylindrical shape according to one embodiment of the present invention, and FIG. 11 is a view illustrating an example of a case in which the seating part 34 provided in the holding module has the arc shape according to one embodiment of the present invention.

FIG. 12 is a vertical cross-sectional view for describing a structure in which the holding module is seated on the spiral rail 44 according to one embodiment of the present invention.

For example, referring to FIG. 12, the plurality of holding modules 35*a*, 35*b*, 35*c*, and 35*d* may be seated on the spiral rail 44, and the rotary plate 42 may relatively move or rotate with respect to the plurality of holding modules 35*a*, 35*b*, 35*c*, and 35*d*.

In this case, the seating parts 34 formed in the plurality of holding modules 35*a*, 35*b*, 35*c*, and 35*d* are seated on the spiral rail 44 in a manner of being non-fixedly coupled to the spiral rail 44.

In addition, for example, the seating part 34 formed in each of the plurality of holding modules 35*a*, 35*b*, 35*c*, and 35*d* may have a recessed shape in the holding module. In this case, the spiral rail 44 may be formed in a protruding shape to be engaged with the recessed shape of the seating part 34 (not illustrated).

As described above, since the seating part 34 formed on each of the plurality of holding modules 35*a*, 35*b*, 35*c*, and 35*d* and the spiral rail 44 are mutually engaged, the plurality of holding modules 35*a*, 35*b*, 35*c*, and 35*d* can be seated on the rotary plate 42.

In this case, the mutually engaging structure of the seating part 34 and the spiral rail 44 should be formed so that the seating part 34 is movable on the spiral rail 44.

That is, as illustrated in FIGS. 8, 9, and 12, the spiral rail 44 may non-fixedly accommodate the plurality of seating parts 34 to serve to provide the spiral guide path to the plurality of seating parts 34.

Meanwhile, since the plurality of seating parts 34 are formed on the plurality of holding modules 35*a*, 35*b*, 35*c*, and 35*d*, it may also be described that the spiral rail 44 provides the spiral guide path to the plurality of holding modules 35*a*, 35*b*, 35*c*, 35*d*).

Meanwhile, as illustrated in FIGS. 5, 7, and 12, the plurality of holding modules 35*a*, 35*b*, 35*c*, and 35*d* are accommodated in the plurality of first accommodation portions 32*a*, 32*b*, 32*c*, 32*d* formed in the first case 40, and are movable within the plurality of first accommodation portions 32*a*, 32*b*, 32*c*, 32*d*, respectively.

When the rotary plate 42 relatively moves or rotates with respect to the plurality of holding modules 35*a*, 35*b*, 35*c*, and 35*d*, the plurality of seating parts 34 move along the spiral rail 44, and thus the plurality of holding modules 35*a*, 35*b*, 35*c*, and 35*d* may move along the spiral rail 44.

In this case, as the plurality of seating parts 34 move along the spiral rail 44, the plurality of holding modules 35*a*, 35*b*, 35*c*, and 35*d* straightly move within the plurality of first accommodation portions 32*a*, 32*b*, 32*c*, 32*d*.

Accordingly, as the plurality of seating parts 34 move along the spiral rail 44, the plurality of holding modules 35*a*, 35*b*, 35*c*, and 35*d* may move toward or away form a center of the holding space AA or the first inner opening BB.

Figure 13:
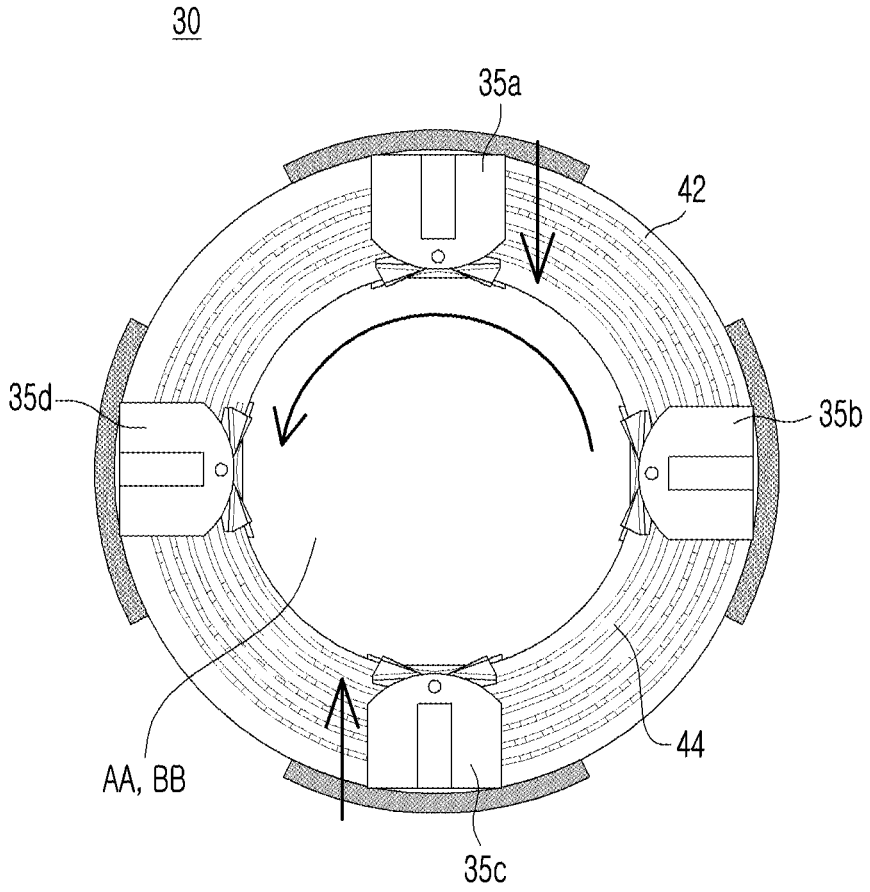
FIGS. 13 and 14 are views for describing an operating principle of the cup holding assembly according to one embodiment of the present invention.
Figure 14:
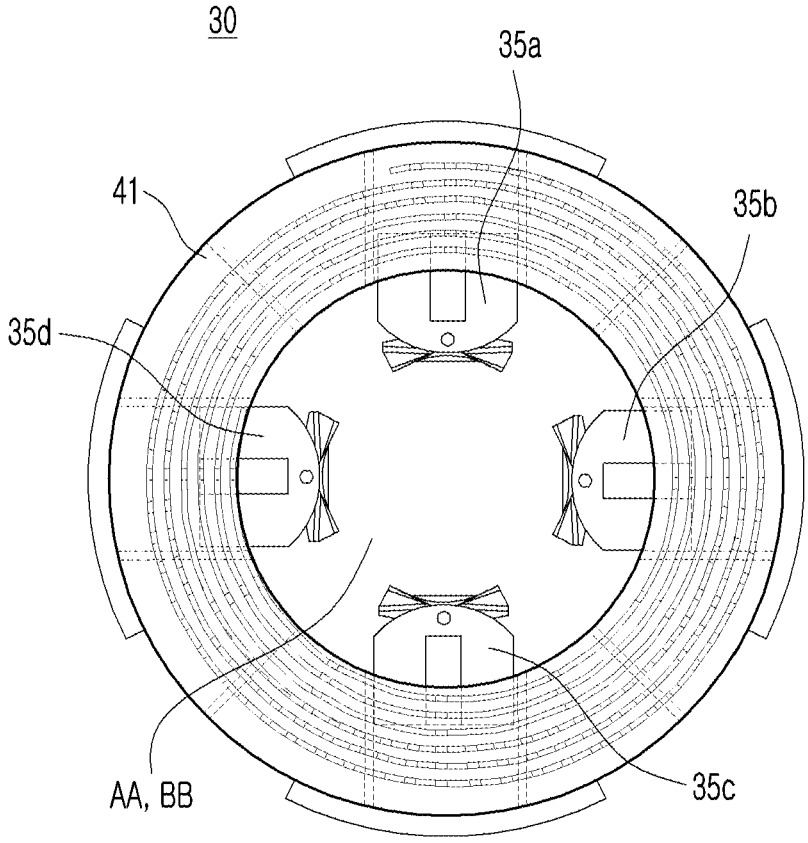

An example in which the plurality of holding modules 35*a*, 35*b*, 35*c*, and 35*d* straightly move within the plurality of first accommodation portions 32*a*, 32*b*, 32*c*, and 32*d* to move toward or away from the center of the holding space AA or the first inner opening BB is illustrated in FIGS. 13 and 14.

FIGS. 13 and 14 are views for describing an operating principle of the cup holding assembly 30 according to one embodiment of the present invention.

For example, in FIG. 13, when a user rotates the rotary plate 42 counterclockwise, a state of FIG. 14 in which the plurality of holding modules 35*a*, 35*b*, 35*c*, and 35*d* straightly move within the plurality of first accommodation portions 32*a*, 32*b*, and 32*c*, and 32*d* to move toward the center of the holding space AA or the first inner opening BB may occur.

In addition, for example, when the user rotates the rotary plate 42 clockwise in FIG. 14, a state of FIG. 13 in which the plurality of holding modules 35*a*, 35*b*, 35*c*, and 35*d* straightly move within the plurality of first accommodation portions 32*a*, 32*b*, 32*c* and 32*d* to move away from the center of the holding space AA or the first inner opening BB may occur.

Meanwhile, the plurality of seating parts 34 may be formed at different positions in the plurality of holding modules 35*a*, 35*b*, 35*c*, 35*d* so that the plurality of holding modules 35*a*, 35*b*, 35*c* and 35*d* are positioned at substantially the same distance from the center of the holding space AA or the first inner opening BB while the plurality of holding modules 35*a*, 35*b*, 35*c*, and 35*d* straightly move within the plurality of first accommodation portions 32*a*, 32*b*, 32*c*, and 32*d*.

Figure 15:
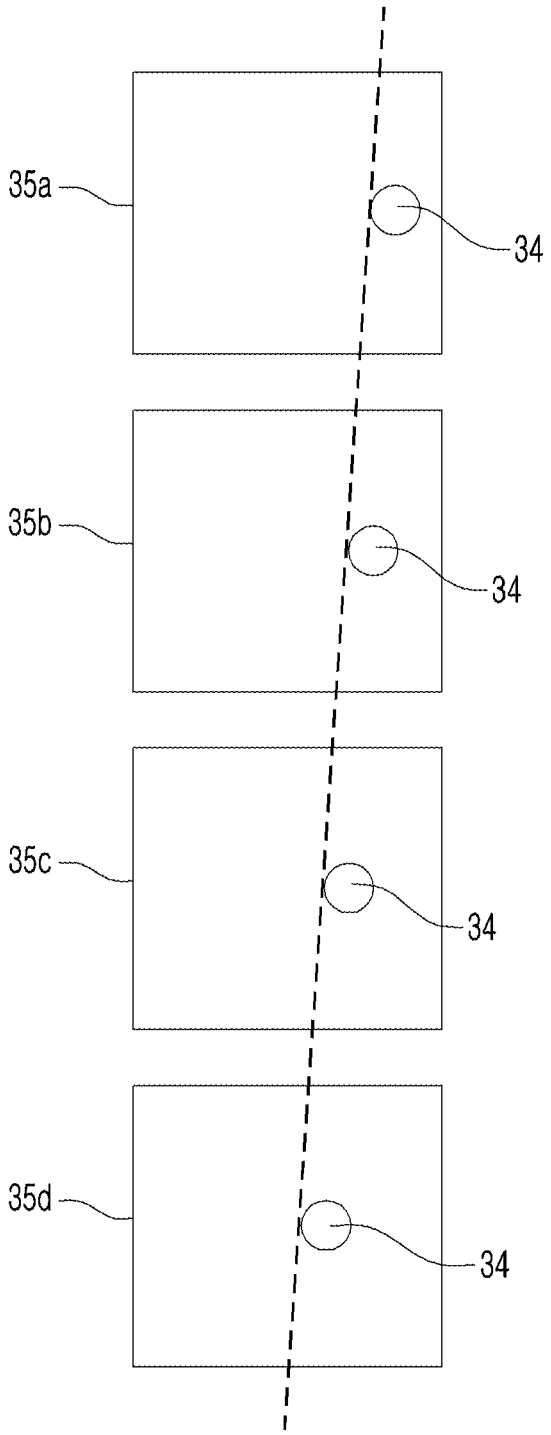
FIG. 15 is a conceptual view illustrating an example in which seating parts are formed at different positions for a plurality of holding modules according to one embodiment of the present invention.

FIG. 15 is a conceptual view illustrating an example in which the seating parts 34 are formed at different positions for the plurality of holding modules 35*a*, 35*b*, 35*c*, and 35*d* according to one embodiment of the present invention.

As described above, the plurality of holding modules 35*a*, 35*b*, 35*c*, and 35*d* may serve to hold the cup positioned in the cup holding assembly 30 according to one embodiment of the present invention.

Although the cup holding assembly 30 according to one embodiment of the present invention may hold any cup, in this specification, a paper cup will be mainly described for the sake of convenience in the description.

Figure 16:
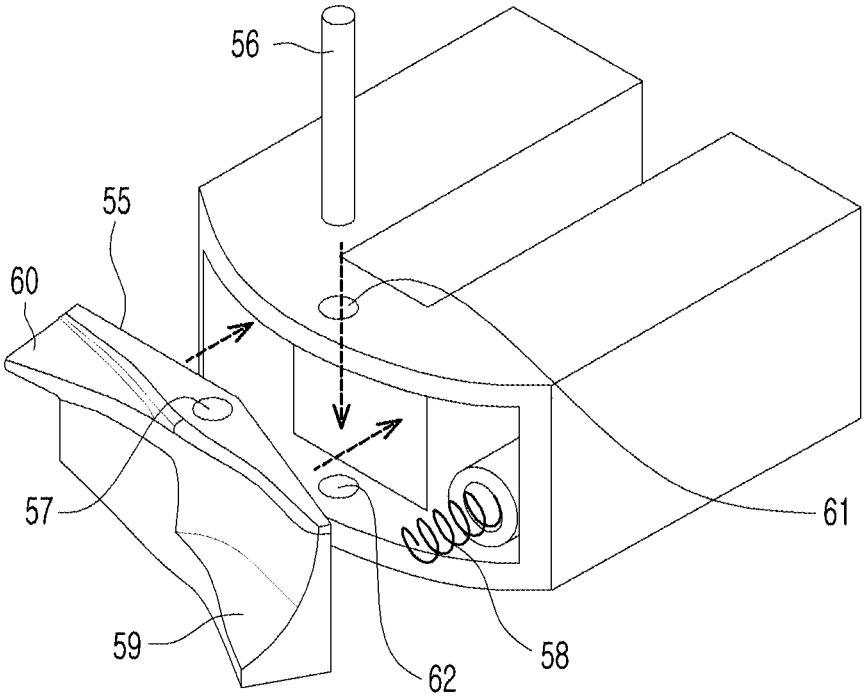
FIG. 16 is a view illustrating a structure of the holding module according to one embodiment of the present invention.

FIG. 16 is a view illustrating a structure of the holding module according to one embodiment of the present invention.

Referring to FIG. 16, among the plurality of holding modules 35*a*, 35*b*, 35*c*, and 35*d*, at least two holding modules include levers 55 whose one ends are pivotably fixed to one side of the holding module and the other ends are coupled to the other side of the holding module using first elastic members 58.

For example, as illustrated in FIG. 16, the first elastic members 58 may be coil springs.

Referring to FIG. 16, the levers 55 may be coupled to the holding module 35*a*, 35*b*, 35*c*, and 35*d* to be rotated clockwise or counterclockwise with respect to the holding modules 35*a*, 35*b*, 35*c*, and 35*d* by first fixing pins 56 which sequentially pass through first holes 61 formed in the holding modules 35*a*, 35*b*, 35*c*, and 35*d*, lever holes 57 formed in the levers 55 and second holes 62 formed in the holding modules 35*a*, 35*b*, 35*c*, and 35*d*.

Meanwhile, an extent, which is a rotational angle, of clockwise or counterclockwise rotation of each of the levers 55 according to whether the cup is present or whether the cup is taken out may be changed by one of the first elastic members 58.

For example, the lever 55 rotates about one of the first fixing pins 56, and an angle between the lever 55 and a body of the cup holding assembly 30 may be changed according to whether the cup is present in the cup holding assembly 30 according to one embodiment of the present invention.

In addition, for example, as the cup is taken out of the cup holding assembly 30 according to one embodiment of the present invention, the angle between the lever 55 and the body of the cup holding assembly 30 may change.

Figure 17:
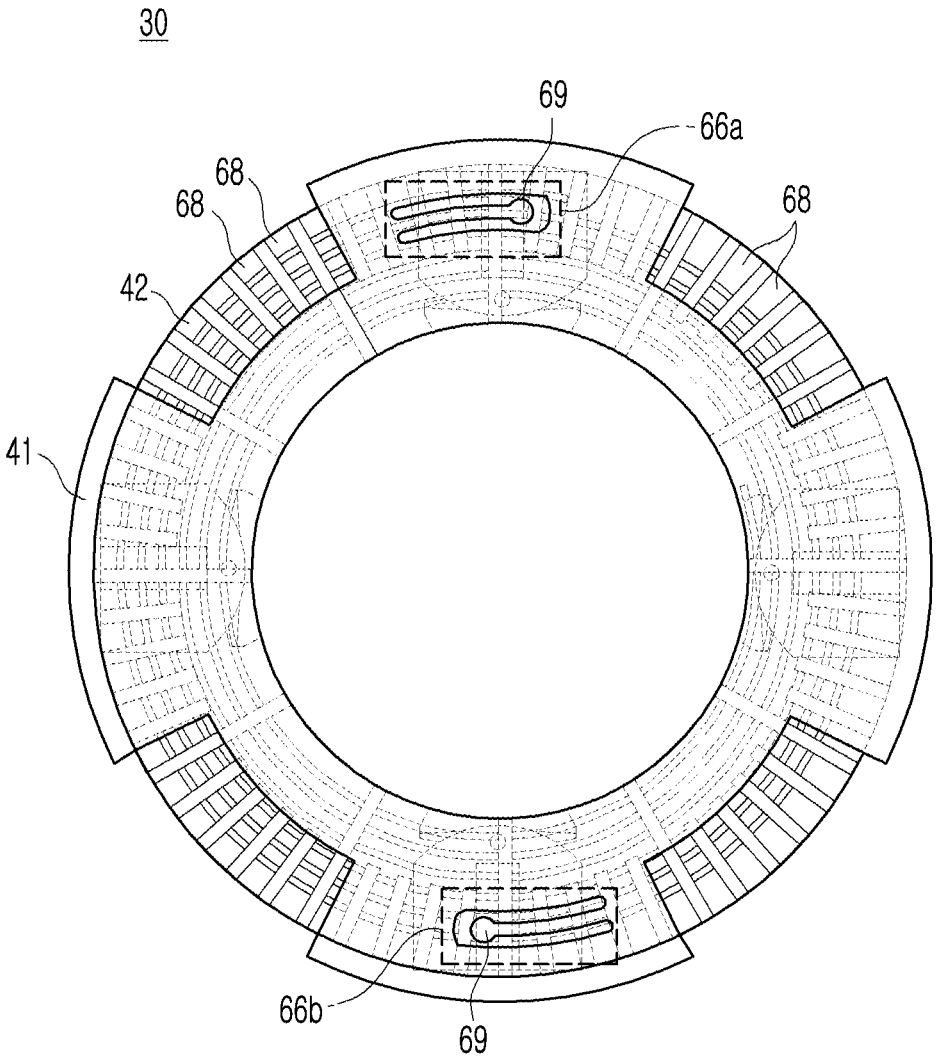
FIG. 17 is a view for describing an example of a position fixing part which may be applied to the cup holding assembly according to one embodiment of the present invention.

FIG. 17 is a view for describing an example of a position fixing part which may be applied to the cup holding assembly 30 according to one embodiment of the present invention.

The second case 41 may include at least one position fixing member 66*a* or 66*b*, and the rotary plate 42 may include a second accommodation portion capable of accommodating the at least one position fixing member 66*a* or 66*b* at an edge of the spiral rail 44.

For example, referring to FIG. 17, the second accommodation portion may be formed as a plurality of grooves 68 disposed on an arc, and the at least one position fixing member 66*a* or 66*b* may be formed to include an elastic member on which a third protrusion 69 having a size sufficient for each of the grooves 68.

In this case, as the rotary plate 42 relatively rotates with respect to the first case 40 or the second case 41, the at least one position fixing member 66*a* or 66*b* may move along the arc on which the plurality of grooves 68 are formed.

When the at least one position fixing member 66*a* or 66*b* is seated in a specific groove 68 after moving along the arc on which the plurality of grooves 68 are disposed, movement of the rotary plate 42 may be temporarily restricted until an external force is applied.

As illustrated in FIG. 17, the at least one position fixing member 66*a* or 66*b* may include the third protrusion 69 having the size sufficient for each of the plurality of grooves 68. The third protrusion 69 may be a plastic hook.

For example, when the third protrusion 69 comes into contact with a wall between the plurality of grooves 68 as the rotary plate 42 rotates, the third protrusion 69 may be pushed up to a height of the wall due to interference and then seated in the groove 68 at the next position of the groove 68.

Hereinafter, the cup holding assembly 30 according to one embodiment of the present invention will be described in detail with operation of the lever 55.

Figure 18:
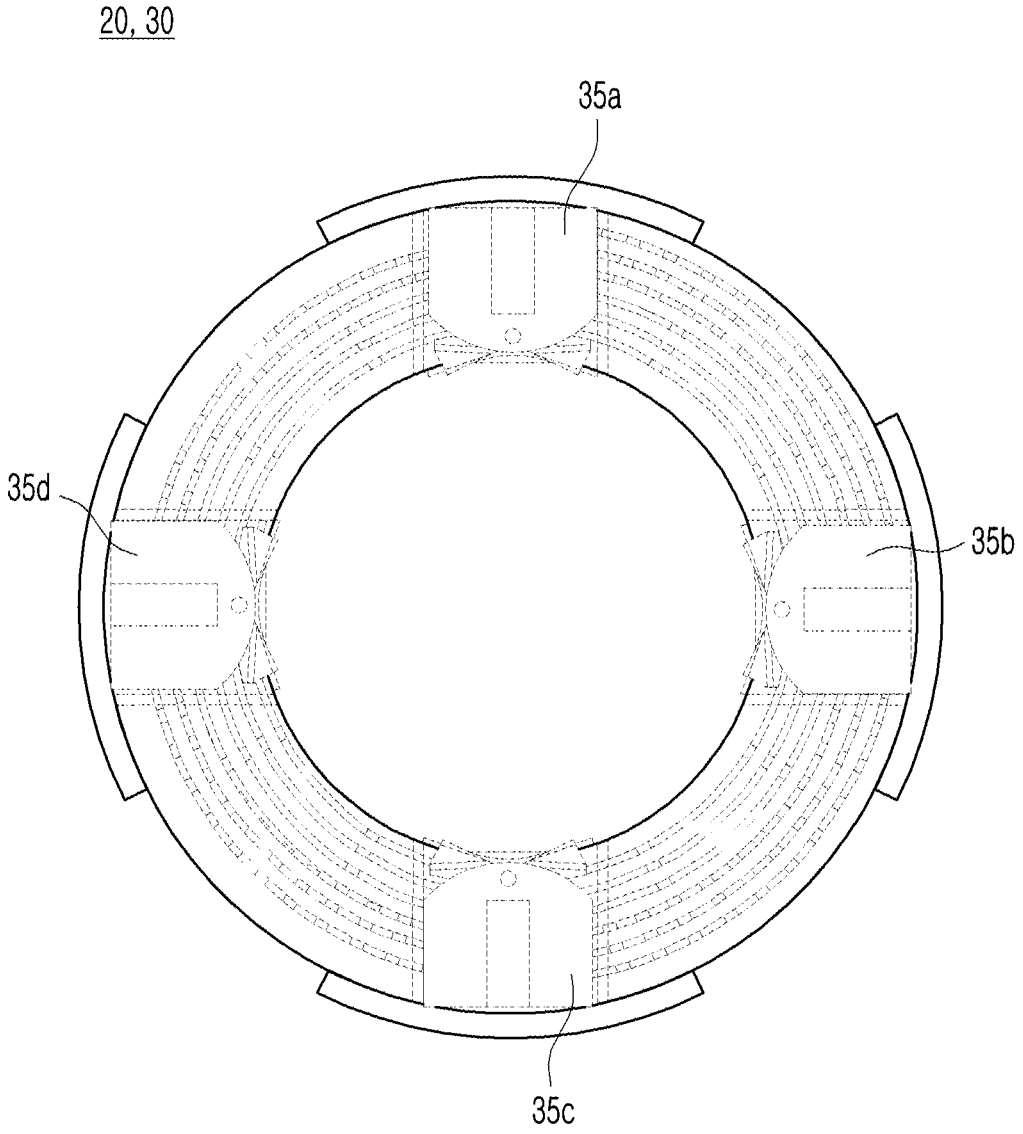
FIGS. 18 and 19 are views illustrating an example of a case in which no cup is in the cup holding assembly according to one embodiment of the present invention.
Figure 19:
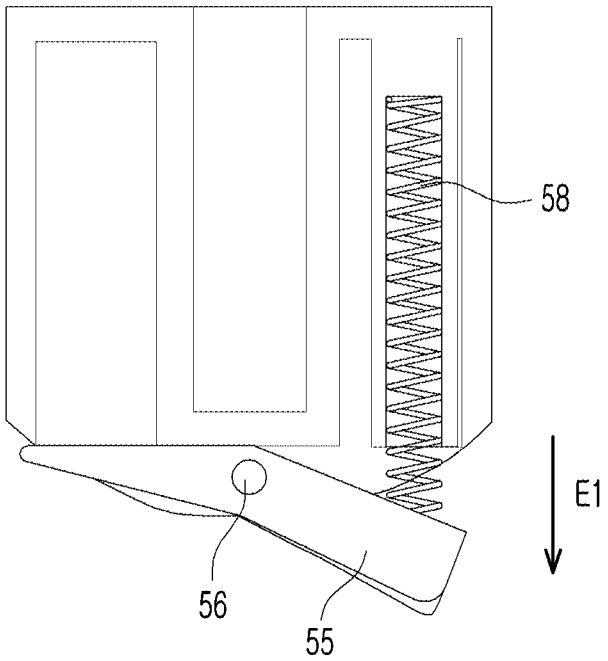

FIGS. 18 and 19 are views illustrating an example of a case in which no cup is in the cup holding assembly 30 according to one embodiment of the present invention.

Referring to FIGS. 18 and 19, when no cup is in the cup holding assembly 30 according to one embodiment of the present invention, one side of the lever 55 in contact with the elastic member 58 is pushed downward more than the other side which is not in contact with the first elastic member 58 due to the first elastic member 58 (see E1 in FIG. 19).

Figure 20:
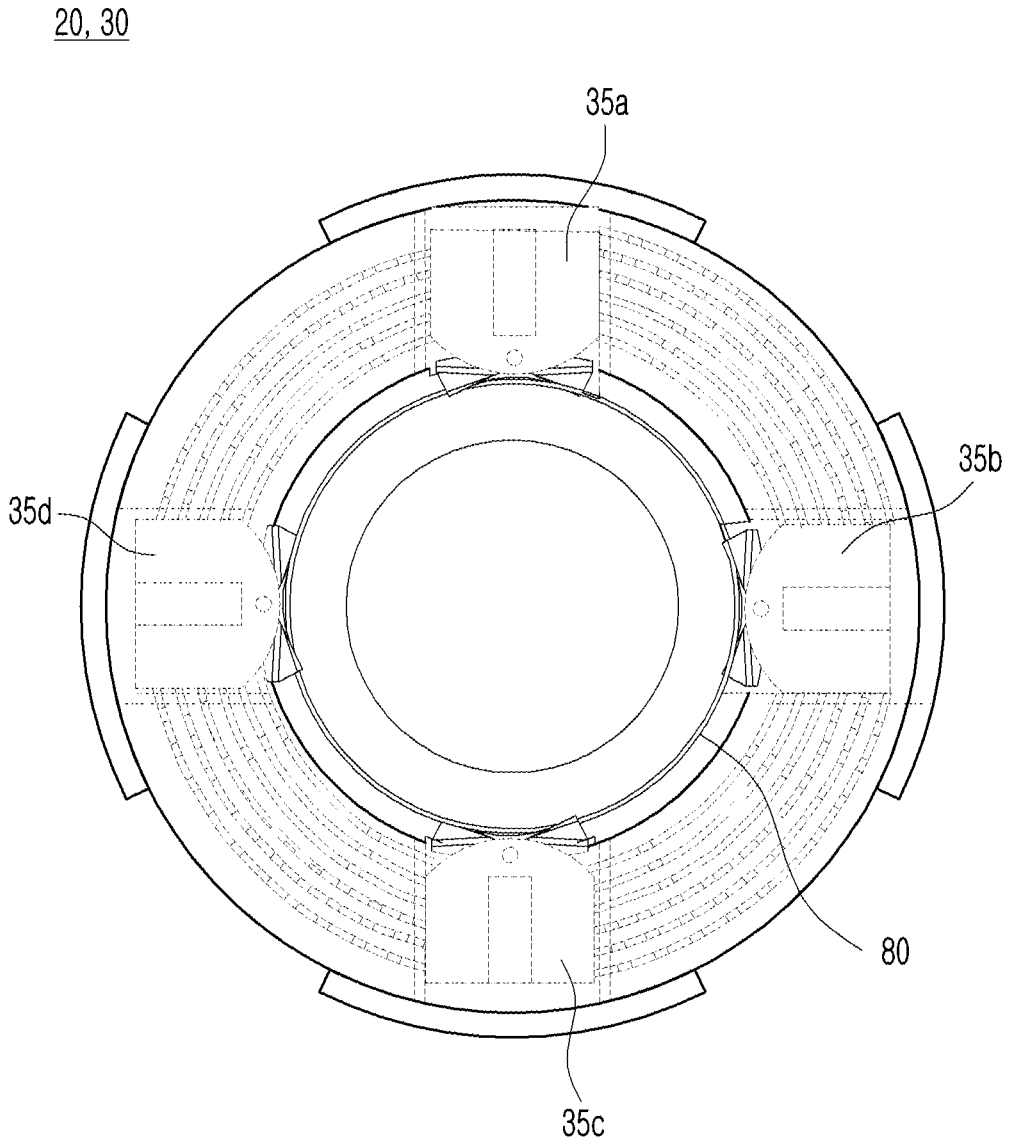
FIGS. 20 to 22 are views illustrating an example of a state in which a cup is held in the cup holding assembly according to one embodiment of the present invention.
Figure 21:
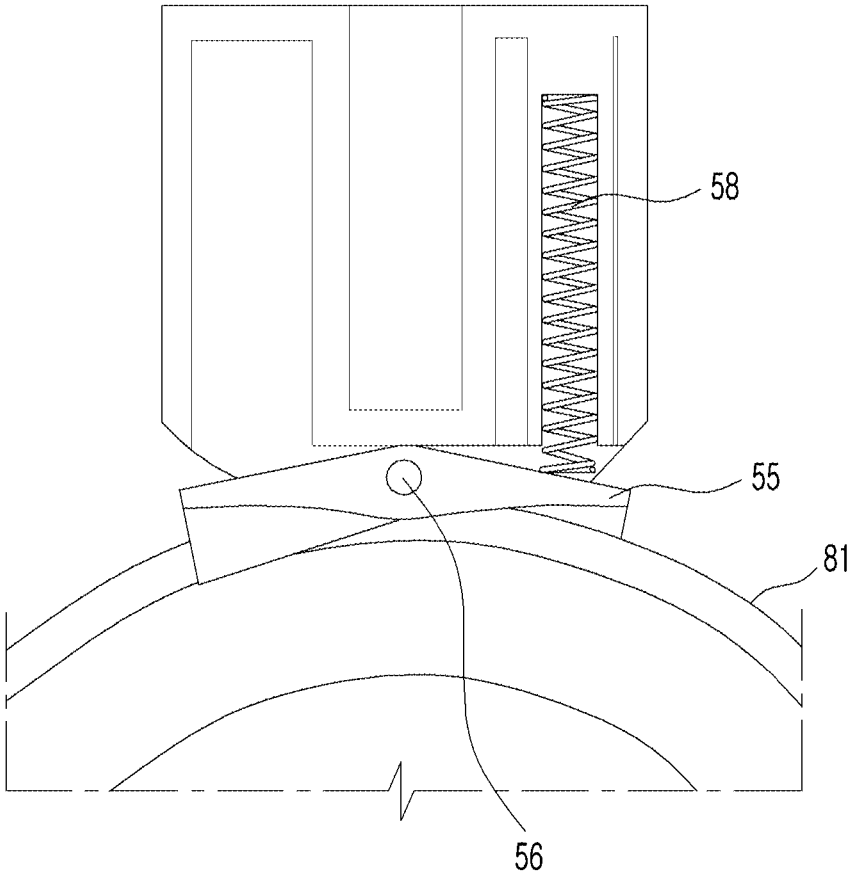
Figure 22:
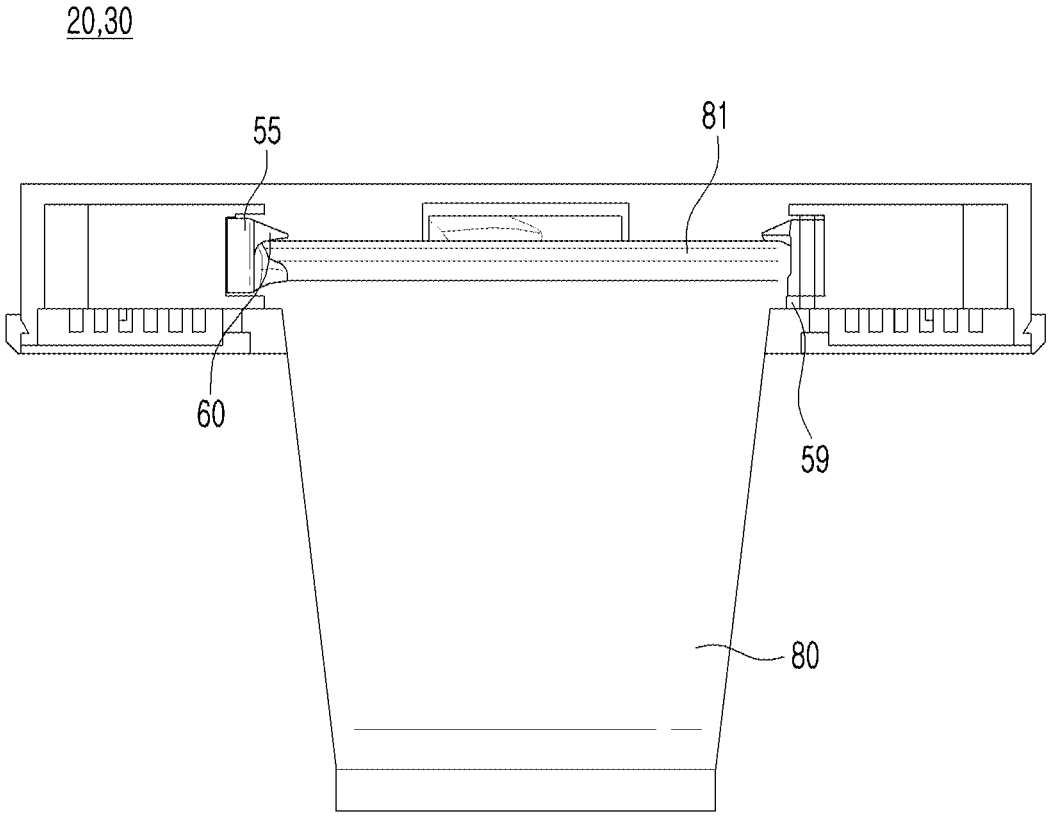

FIGS. 20 to 22 are views illustrating an example of a state in which a cup is held in the cup holding assembly 30 according to one embodiment of the present invention.

Referring to FIGS. 20 to 22, when cups 80 and 81 are inserted into the cup holding assembly 30, a right side of the lever 55 is pushed toward the modules 35*a*, 35*b*, 35*c* and 35*d* by the inserted cups 80 and 81.

In this case, the lever 55 in a state illustrated in FIG. 19 is rotated at a predetermined angle about each of the first fixing pins 56 counterclockwise and thus enters a state illustrated in FIG. 21.

The lever 55 may be supported by an elastic force or restoring force of the first elastic member 58 while pushed by the holding modules 35*a*, 35*b*, 35*c*, and 35*d* due to the inserted cups 80 and 81.

Meanwhile, referring to FIG. 16, a first protrusion 59 may be formed on a lower end of one side of the lever 55, and a second protrusion 60 may be formed on an upper end of the other side of the lever 55.

For example, as illustrated in FIG. 16, the first protrusion 59 may be formed on a lower end of a right side of the lever 55, and the second protrusion 60 may be formed on an upper end of a left side of the lever 55.

As illustrated in FIG. 22, the first protrusion 59 and the second protrusion 60 may serve to stably support the inserted cups 80 and 81.

For example, in FIG. 22, the first protrusion 59 may support a protrusion of an upper end of the cup 80 positioned at a lower side, and the second protrusion 60 may support a protrusion of an upper end of the cup 81 positioned at an upper side.

Figure 23:
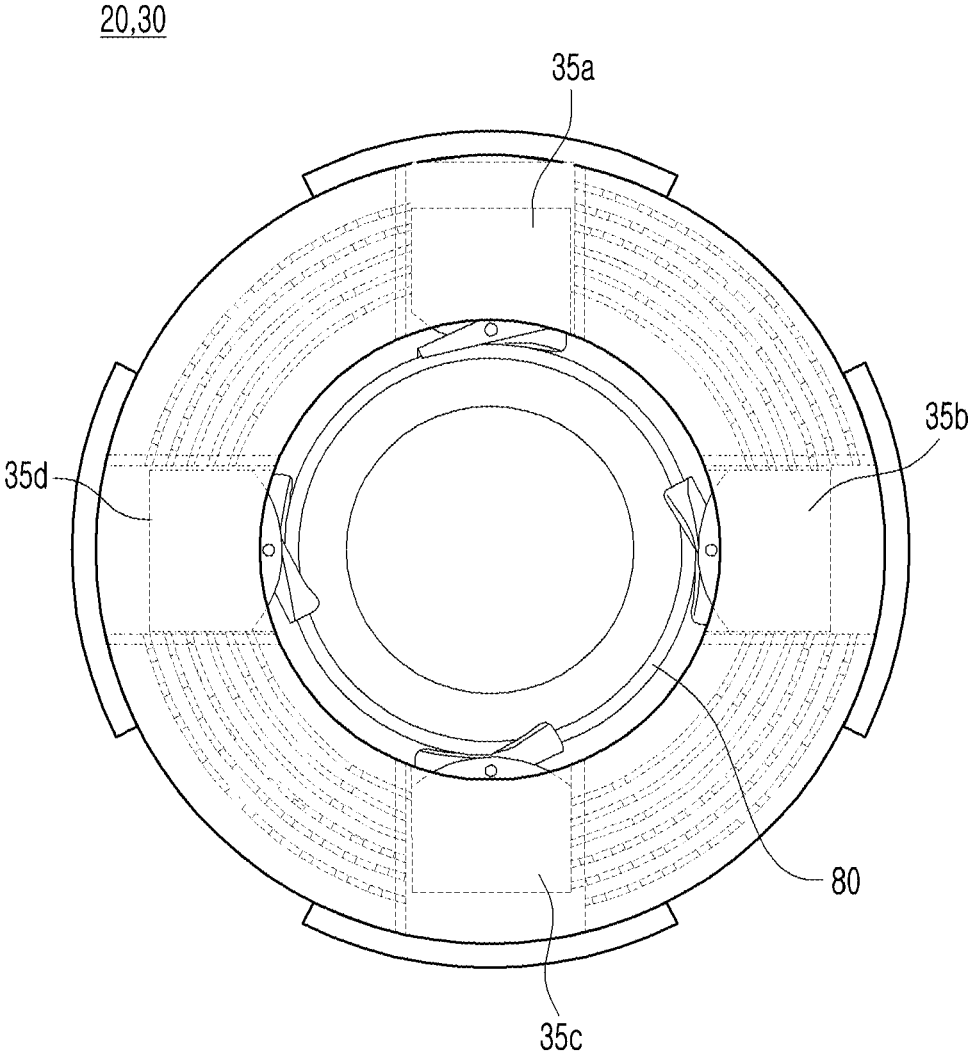
FIGS. 23 to 25 are views illustrating an example of a state in which the cup is taken out of the cup holding assembly according to one embodiment of the present invention.
Figure 24:
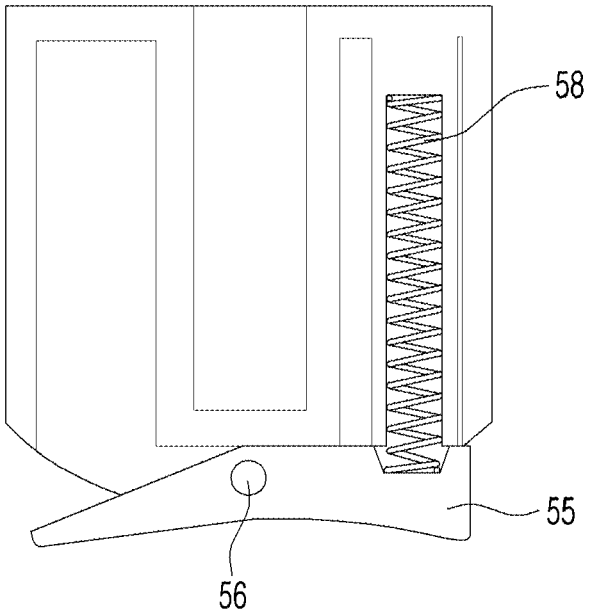
Figure 25:
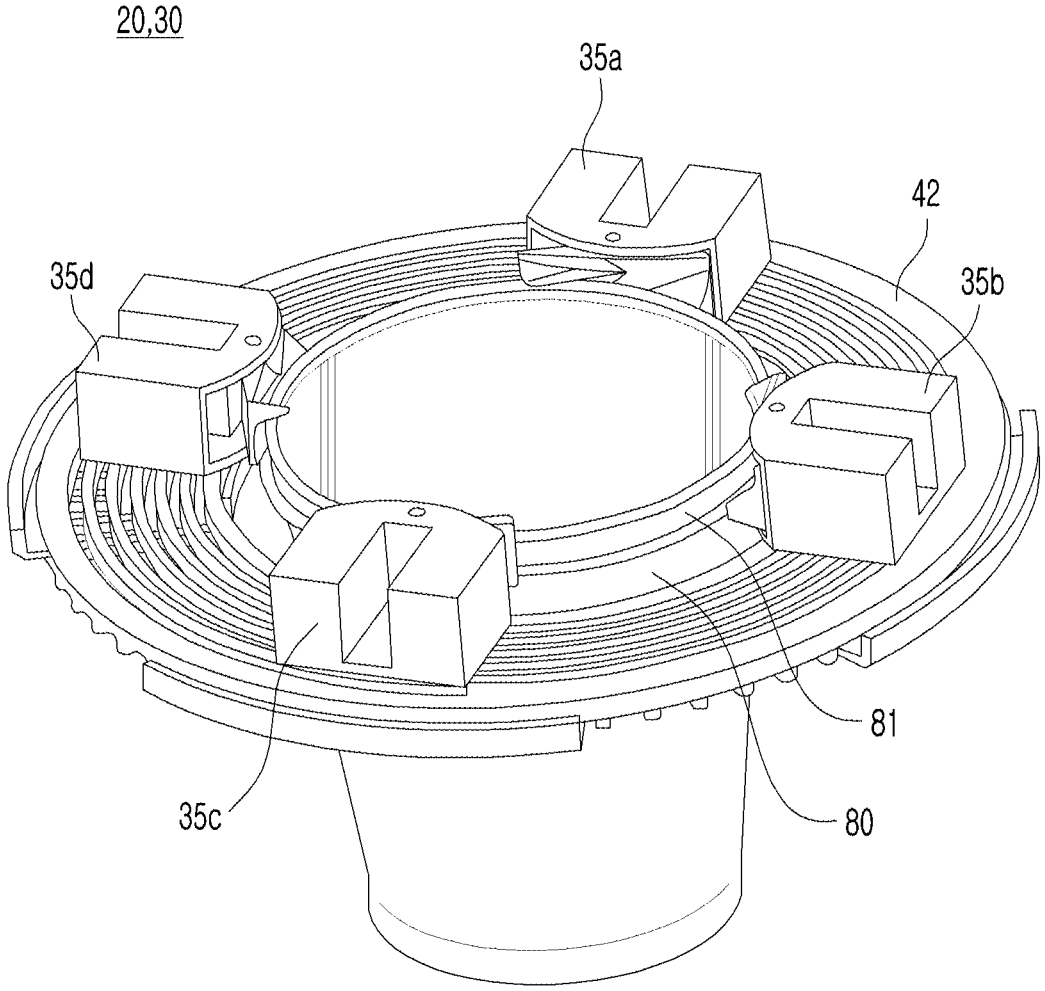

FIGS. 23 to 25 are views illustrating an example of a state in which the cup is taken out of the cup holding assembly 30 according to one embodiment of the present invention.

Referring to FIGS. 23 to 25, when the cup 80 positioned at the lower side is taken out of the cup holding assembly 30, the upper end of the cup 80 positioned at the lower side, particularly, the protrusion of the upper end of the cup 80 positioned at the lower side pushes the first protrusion 59, and thus the lever 55 is maximally pushed toward the holding modules 35*a*, 35*b*, 35*c*, and 35*d* in order for the cup 80 positioned at the lower side to be taken out of the cup holding assembly 30.

In this case, when a length of the first elastic member 58 becomes the shortest and the cup 80 positioned at the lower side is completely taken out, the lever 55 may be restored to the state of FIG. 19 or FIG. 21 by a restoring force of the first elastic member 58.

As described above, in the cup holding assembly 30 according to one embodiment of the present invention, the plurality of holding modules 35*a*, 35*b*, 35*c*, and 35*d* may move toward or away from the center of the holding space AA or the first inner opening BB or a center of the second inner opening CC of the cup holding assembly 30.

Accordingly, according to the cup holding assembly 30 according to one embodiment of the present invention, cups having various diameters can be held.

For example, when a user uses a cup having a small diameter, the plurality of holding modules 35*a*, 35*b*, 35*c*, and 35*d* may move toward the center of the holding space AA, the first inner opening BB, or the second inner opening CC, and thus a space constituted by ends of the plurality of holding modules 35*a*, 35*b*, 35*c*, and 35*d* can be reduced.

In addition, for example, when a user uses a cup having a large diameter, the plurality of holding modules 35*a*, 35*b*, 35*c*, and 35*d* may move away from the center of the holding space AA, the first inner opening BB, or the second inner opening CC, and thus a space constituted by the ends of the plurality of holding modules 35*a*, 35*b*, 35*c*, and 35*d* can be increased.

Meanwhile, the dental cup dispenser 20 according to one embodiment of the present invention may include the cup holding assembly 30 according to one embodiment of the present invention described above with reference to FIGS. 5 to 25.

In this specification, the terms "one embodiment" and the like of the principles of the present invention and names of various variations of such expression mean that particular features, structures, characteristics, and the like related to the embodiment are included in at least one embodiment of the principles of the present invention.

Therefore, all of the term "in one embodiment" and any arbitrary other variations disclosed throughout this specification do not necessarily refer to the same embodiment.

When a method in this specification includes a series of steps, an order of these steps suggested herein is not necessarily an order in which these steps should be necessarily performed, and described arbitrary steps may be omitted and/or arbitrary other step, which is not described here, may be added to the method.

In addition, in this specification, unless clearly indicated otherwise by context, singular forms include the plural forms thereof. In addition, the terms "comprise" and "comprising," when used herein, specify some stated components, steps, operations, and elements including one or more other components, steps, operations, and/or elements.

The present invention has been described above with reference to exemplary embodiments. All embodiments and conditional examples disclosed throughout this specification are described with the intention of helping those skilled in the art to understand the principles and concepts of the present invention, and those skilled in the art may understand that the present invention may be implemented in modified forms within a range without departing from the essential characteristics of the present invention. Therefore, the embodiments should be considered in a descriptive sense only and not for purposes of limitation.

The scope of the present invention is defined not by the above description but by the appended claims, and it should be interpreted that the scope of the present invention encompasses all differences falling within equivalents of the appended claims.

The invention claimed is:

1. A cup holding assembly for holding a cup, comprising:

a plurality of holding modules disposed to hold a cup by coming into contact with the cup in a plurality of directions in a holding space, wherein each of the plurality of holding modules has a seating part; and a rotary plate having (i) an inner opening overlapping the holding space and (ii) at least one spiral rail coupled to the plurality of seating parts in a non-fixed manner to provide a spiral guide path to each of the plurality of seating parts, wherein the plurality of seating parts each move along the spiral guide path as the rotary plate rotates, and the plurality of holding modules move toward or away from a center of the holding space or a center of a first inner opening as the plurality of seating parts move, wherein a curvature of the spiral rail decreases away from the holding space and the first inner opening.

2. The cup holding assembly according to claim 1, wherein:

each of the plurality of seating parts has a protruding portion extending outward from the holding module; and the spiral rail is formed to be recessed to accommodate the protruding shape of the seating parts.

3. The cup holding assembly according to claim 2, wherein each of the plurality of seating parts has a cylindrical or arcuate portion protruding outward from the holding module.

4. The cup holding assembly according to claim 1, wherein the plurality of seating parts are formed at different positions on the plurality of holding modules so that the plurality of holding modules come into contact with the cup at the same distance from the center of the holding space or the center of the first inner opening.

5. A dental cup dispenser comprising:

a first case including a plurality of first accommodation portions and defining a holding space;

a plurality of holding modules accommodated in the plurality of first accommodation portions, the plurality of holding modules being movable within the plurality of first accommodation portions, each of the plurality of holding modules including a seating part and being configured to hold a cup by contacting the cup in the holding space from a plurality of directions; and a rotary plate including (i) a first inner opening that overlaps the holding space and (ii) at least one spiral rail coupled to the plurality of seating parts in a non-fixed manner to provide a spiral guide path to each of the plurality of seating parts, wherein the plurality of seating parts each move along the spiral guide path as the rotary plate rotates, and the plurality of holding modules move toward or away from a center of the holding space or a center of the first inner opening in response to movement of the plurality of seating parts, wherein a curvature of the spiral rail decreases away from the holding space and the first inner opening.

6. The cup holding assembly of claim 1, wherein at least two holding modules among the plurality of holding modules each includes a lever having a first end pivotably fixed to a first side of the holding module and a second end coupled to a second side of the holding module using elastic members.

7. The cup holding assembly according to claim 6, wherein a rotational angle of the lever in a clockwise or counterclockwise direction varies depending on whether the cup is seated in or removed from the holding module.

8. The dental cup dispenser of claim 5, wherein the plurality of seating parts are formed at different positions on the plurality of holding modules so that the plurality of holding modules are positioned at the same distance from the center of the holding space or the center of the first inner opening.

9. The dental cup dispenser of claim 5, further comprising a second case coupled to the first case so that the plurality of holding modules and the rotary plate are positioned between the first case and the second case.

10. The dental cup dispenser of claim 5, wherein at least two holding modules among the plurality of holding modules each include a lever whose one end is pivotably fixed to one side of the holding module and the other end is coupled to the other side of the holding module by an elastic member.

11. The dental cup dispenser of claim 10, wherein an extent of clockwise or counterclockwise rotation of the lever is changed by the elastic member according to whether a cup is present or whether the cup is taken out.

12. The dental cup dispenser of claim 11, wherein:

a first protrusion is formed on a lower end of one side of the lever; and the elastic member is pushed toward an inside of the holding module when the cup is taken out.

13. The dental cup dispenser of claim 12, wherein a second protrusion is formed on an upper end of the other side of the lever.

14. The dental cup dispenser of claim 9, wherein a second inner opening overlapping the holding space is formed in the second case.

15. The dental cup dispenser of claim 9, wherein:

the second case includes at least one position fixing member; and the rotary plate includes a second accommodation portion for accommodating the at least one position fixing member at an edge of the spiral rail.

16. The dental cup dispenser of claim 15, wherein:

the second accommodation portion is formed as a plurality of grooves forming an arc; and the at least one position fixing portion moves along the plurality of grooves as the rotary plate relatively rotates with respect to the first case or the second case.

17. The dental cup dispenser of claim 16, wherein, when the at least one position fixing member is seated in any groove among the plurality of grooves, movement of the rotary plate is temporarily restricted until an external force is applied.

18. The dental cup dispenser of claim 16, wherein the at least one position fixing member includes an elastic member on which a third protrusion having a size sufficient for each of the grooves is formed.

* * * * *